US010847298B2

(12) United States Patent
Kudo et al.

(10) Patent No.: US 10,847,298 B2
(45) Date of Patent: Nov. 24, 2020

(54) COIL DEVICE

(71) Applicant: TDK CORPORATION, Tokyo (JP)

(72) Inventors: Takashi Kudo, Tokyo (JP); Makoto Morita, Tokyo (JP); Fuyuki Miura, Tokyo (JP); Naoki Satou, Tokyo (JP); Kyohei Tonoyama, Tokyo (JP); Yasunori Chiba, Tokyo (JP); Masanori Sugai, Tokyo (JP); Junichi Aoyado, Tokyo (JP)

(73) Assignee: TDK CORPORATION, Tokyo (JP)

( * ) Notice: Subject to any disclaimer, the term of this patent is extended or adjusted under 35 U.S.C. 154(b) by 186 days.

(21) Appl. No.: 15/886,485

(22) Filed: Feb. 1, 2018

(65) Prior Publication Data

US 2018/0226184 A1 Aug. 9, 2018

(30) Foreign Application Priority Data

Feb. 7, 2017 (JP) ..... 2017-020659

(51) Int. Cl.

| | |
|---|---|
| ***H01F 27/28*** | (2006.01) |
| ***H01F 17/00*** | (2006.01) |
| ***H01F 41/04*** | (2006.01) |
| ***H01F 27/24*** | (2006.01) |
| ***H01F 17/04*** | (2006.01) |

(52) U.S. Cl.

CPC ..... *H01F 27/28* (2013.01); *H01F 17/0033* (2013.01); *H01F 17/04* (2013.01); *H01F 27/24* (2013.01); *H01F 41/04* (2013.01); *H01F 2017/048* (2013.01)

(58) Field of Classification Search

CPC ..... H01F 27/28; H01F 17/0033; H01F 27/24; H01F 27/2804; H01F 2027/2809; H01F 27/29

USPC ..... 336/83, 200, 232

See application file for complete search history.

(56) References Cited

U.S. PATENT DOCUMENTS

| | | | | |
|---|---|---|---|---|
| 2015/0137929 | A1 | 5/2015 | Park | |
| 2016/0035476 | A1 | 2/2016 | Mimura et al. | |
| 2017/0169930 | A1* | 6/2017 | Kudo | H01F 17/0013 |
| 2017/0178793 | A1 | 6/2017 | Muneuchi | |
| 2017/0178798 | A1* | 6/2017 | Yoon | H01F 27/292 |
| 2017/0301458 | A1 | 10/2017 | Mimura et al. | |

FOREIGN PATENT DOCUMENTS

| | | | | |
|---|---|---|---|---|
| CN | 104658739 | A | | 5/2015 |
| JP | 2005-116708 | A | | 4/2005 |
| JP | 2011-003761 | A | | 1/2011 |
| JP | 2011003761 | A | * | 1/2011 |
| JP | 2016-032050 | A | | 3/2016 |
| KR | 101670184 | B1 | | 10/2016 |
| WO | 2016/035861 | A1 | | 3/2016 |

* cited by examiner

*Primary Examiner* — Tszfung J Chan
(74) *Attorney, Agent, or Firm* — Oliff PLC

(57) ABSTRACT

A coil device includes a conductor and a terminal electrode. The conductor is embedded in a core body and wound in a coil shape. The terminal electrode is formed on an end surface of the core body and connected with a lead end of the conductor. The coil device further includes a dummy conductor embedded in the core body separately from the conductor. An end part of the dummy conductor exposed from the end surface of the core body separately from the lead end is connected with the terminal electrode.

7 Claims, 8 Drawing Sheets

COIL DEVICE

BACKGROUND OF THE INVENTION

1. Field of the Invention

The present invention relates to a coil device where a coil is embedded in a core body.

2. Description of the Related Art

As such a coil device, inductors of Patent Documents 1 and 2 are known. In the inductor of Patent Document 1, an end part (lead end) of a wire constituting a coil is cut obliquely, and this cut surface is connected with a terminal electrode. This enhances a joint strength between the lead end and the terminal electrode and can improve a joint strength between an element body (core body) and the terminal electrode with the lead end.

In the coil of Patent Document 2, joint reliability is improved by joining an end of a wire with a conductive resin or so and connecting the end of the wire integrated with the conductive resin or so with a terminal electrode.

Even in the techniques of Patent Documents 1 and 2, however, a joint strength between the core body and the terminal electrode is insufficient, and the terminal electrode may peel from the core body.

Patent Document 1: JP 2005-116708 A

Patent Document 2: JP 2011-3761 A

SUMMARY OF THE INVENTION

The present invention has been achieved under such circumstances. It is an object of the invention to provide a coil device having a high joint strength of a terminal electrode.

To achieve the above object, the coil device according to the present invention is a coil device comprising:

a conductor embedded in a core body and wound in a coil shape; and a terminal electrode formed on an end surface of the core body and connected with a lead end of the conductor;

wherein the coil device further comprises a dummy conductor embedded in the core body separately from the conductor, and an end part of the dummy conductor exposed from the end surface of the core body separately from the lead end is connected with the terminal electrode.

In the coil device according to the present invention, the dummy conductor is embedded in the core body separately from the conductor wound in a coil shape, and the end part of the dummy conductor is connected with the terminal electrode. In addition to the lead end of the conductor, the end of the dummy conductor is thereby connected with the terminal electrode, and the terminal electrode becomes hard to peel from the core body. As a result, a peeling strength of the terminal electrode from the core body is improved.

The dummy conductor may be arranged close to the lead end so as to overlap with the lead end along a winding axis direction of the conductor on the end surface of the core body. In this configuration, also due to a pressure at the time of molding the core body, an added pressure at the time of cutting the core body, and the like, the lead end is hard to be deformed, and a positional displacement of the lead end is hard to occur.

Instead, the dummy conductor may be arranged on an opposite side to the lead end with a center of a winding axis of the conductor on the end surface of the core body. In this configuration, connection parts of the conductors are formed on both sides of the end surface of the core body, and a peeling strength of the terminal electrode from the core body is improved with good balance between both sides of the end surface of the core body.

The core body may be composed of any material, such as a synthetic resin and a synthetic resin containing a magnetic material. When the core body contains a magnetic material, the core body becomes a magnetic path, and inductance is improved.

A manufacturing method of the coil device according to the present invention, comprising the steps of:

arranging a plurality of conductors wound in a coil shape in a core body aggregate at least along a first axis direction;

cutting the core body aggregate along a cut projected line along a second axis direction crossing the first axis direction and forming a plurality of core bodies containing a single conductor; and forming a terminal electrode on an end surface of the core body cut along the cut projected line, wherein the plurality of conductors is arranged in the core body aggregate so that a tip of one conductor intrudes into the other region where the other conductor is arranged over the cut projected line, and that a tip of the other conductor intrudes into one region where one conductor is arranged over the cut projected line, among the conductors adjacent to each other in the first axis direction, when the core body aggregate is cut along the cut projected line, a tip of the conductor contained in one core body corresponding with one region is separated to form a lead end, and a tip of the other conductor intruded from the other region is separated and remains as a dummy conductor, and when the terminal electrode is formed on the end surface of one core body corresponding with one region, the terminal electrode is connected with the lead end and is also connected with the dummy electrode.

In the manufacturing method of the coil device according to the present invention, the plurality of conductors (coil shape) is arranged so that the tip of one conductor and the tip of the other conductor intrude into mutual regions over the cut projected line among the conductors adjacent to each other in the first axis direction. Thus, when the core body aggregate is cut along the cut projected line, a tip of the conductor contained in one core body corresponding with one region is separated to form a lead end, and a tip of the other conductor intruded from the other region is separated and remains as a dummy conductor. When the terminal electrode is formed on a cut surface of the core body, the terminal electrode is simultaneously connected with both of the lead end and the dummy conductor, the terminal electrode becomes hard to peel from the core body, and a connection strength of the terminal electrode is improved.

The tip of one conductor and the tip of the other conductor may be closely arranged to overlap with each other along a third axis direction crossing the first axis direction and the second axis direction in one region.

Instead, the tip of one conductor and the tip of the other conductor may be arranged separately on the opposite side along the second axis in one region.

BRIEF DESCRIPTION OF THE DRAWINGS

FIG. 2E(b) is a schematic perspective view showing a next step of FIG. 2E(a).

DETAILED DESCRIPTION OF THE PREFERRED EMBODIMENT

Hereinafter, the present invention is described based on embodiments shown in figures.

First Embodiment

Figure 1:
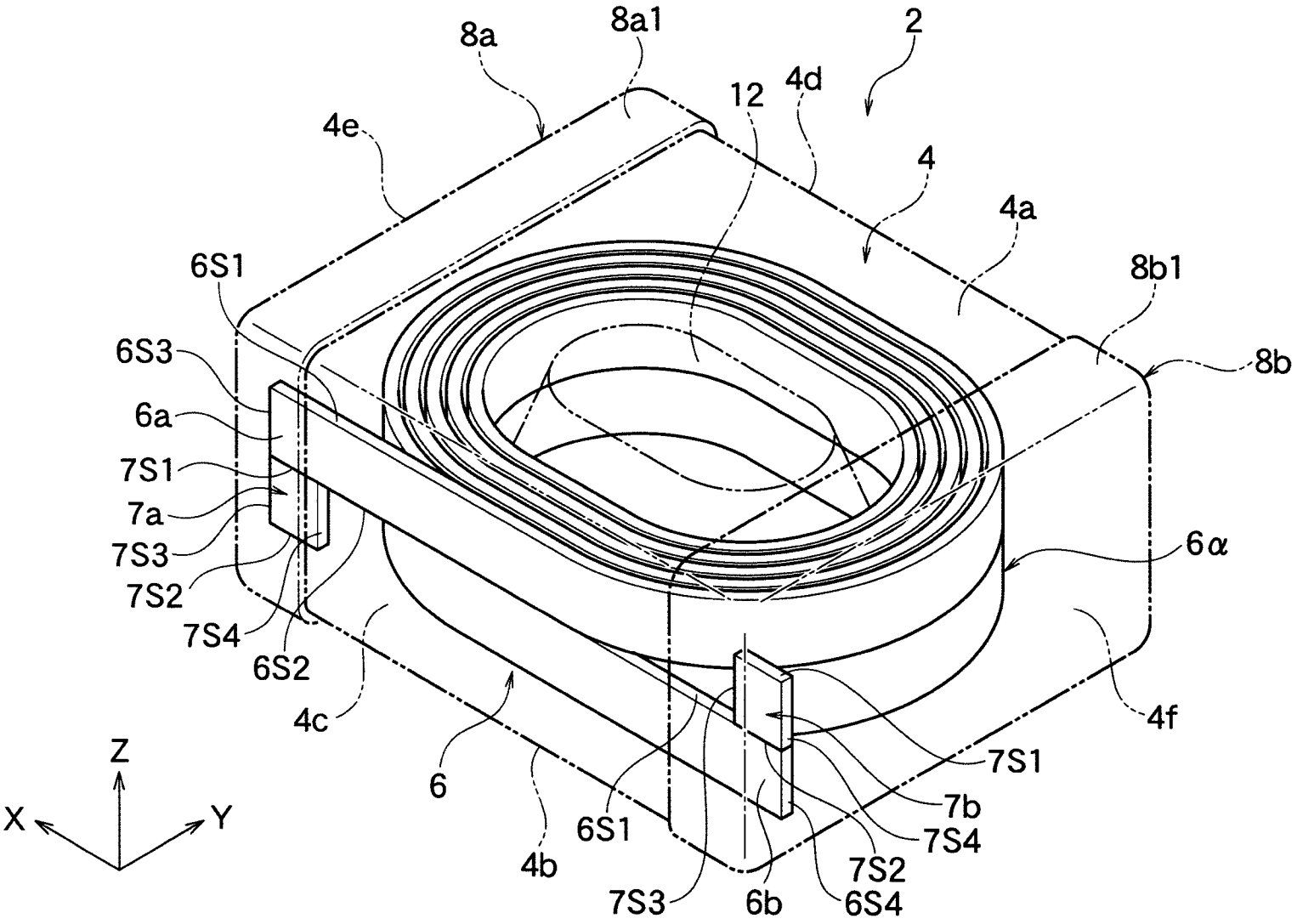
FIG. 1 is a perspective view of an inductor according to First Embodiment of the present invention.

As shown in FIG. 1, an inductor 2 as a coil device according to First Embodiment of the present invention has a core body 4 with an approximately rectangular parallelepiped shape. The core body 4 has any length (X-axis/first axis), any width (Y-axis/second axis), and any height (Z-axis/third axis). For example, the core body 4 preferably has a length (X-axis) of 1.4 to 6.5 mm, a width (Y-axis) of 0.6 to 6.5 mm, and a height (Z-axis) of 0.5 to 5.0 mm.

A wire 6 as a conductor wound in a coil shape is embedded in the core body 4. In the present embodiment, a wire with insulation film is preferably used as the wire 6. This is because even if a metal magnetic powder is dispersed in a main component constituting the core body 4, a core wire and the metal magnetic powder of the core body 4 are hardly short-circuited, withstand voltage characteristic is improved, and inductance is prevented from deteriorating.

In the present embodiment, for example, the wire 6 is constituted by a rectangular wire composed of a copper wire covered with an insulation film. The insulation film may be an epoxy modified acrylic resin or so. Incidentally, the wire 6 may be a copper or silver wire covered with an enamel film.

The core body 4 has four side surfaces 4*a* to 4*d* and two end surfaces 4*e* and 4*f* facing each other in the X-axis direction. In the core body 4, the wire 6 is wound in a coil shape by one or more turns and constitutes a coil part 6*a*. In the present embodiment, the coil part 6*a* is constituted by an air-core coil where the coil 6 is wound by a-winding, but may be constituted by an air-core coil where the coil 6 is wound by general normal wise or may be constituted by an air-core coil where the coil 6 is wound by edgewise.

In the present embodiment, the core body 4 housing the wire 6 is composed of a synthetic resin where ferrite particles or metal magnetic particles are dispersed. The core body 4 may be, however, composed of a synthetic resin failing to contain the particles. Examples of the ferrite particles include a Ni—Zn based ferrite and a Mn—Zn based ferrite. Examples of the metal magnetic particles include a Fe—Ni alloy powder, a Fe—Si alloy powder, a Fe—Si—Cr alloy powder, a Fe—Co alloy powder, and a Fe—Si—Al alloy powder.

Examples of the synthetic resin contained in the core body 4 preferably include an epoxy resin, a phenol resin, a polyester resin, a polyurethane resin, and a polyimide resin.

In the present embodiment, a pair of the end surfaces 4*e* and 4*f* facing each other in the X-axis direction and a pair of the side surfaces 4*c* and 4*d* facing in the Y-axis direction of the core body 4 shown in FIG. 1 are cut surfaces (external cut surfaces) in a manufacturing process of the core body 4. A pair of the side surfaces 4*a* and 4*b* of the core body 4 facing each other in the Z-axis direction is a molding surface when the core body 4 is obtained by powder molding. When the core body 4 is constituted by a laminated body of sheets, the side surfaces 4*a* and 4*b* correspond with a surface of the sheets.

As shown in FIG. 1, the pair of the end surfaces 4*e* and 4*f* facing each other in the X-axis direction is covered with terminal electrodes 8*a* and 8*b*. The side surfaces 4*a* to 4*d* close to the end surfaces 4*e* and 4*f* are also covered with an extended cover part 8*a*1 of the terminal electrode 8*a* and an extended cover part 8*b*1 of the terminal electrode 8*b*.

For example, the terminal electrodes 8*a* and 8*b* are constituted by a multilayer electrode film, a base electrode film is constituted by a conductive paste film containing metals of Sn, Ag, Ni, C, etc. or alloy thereof, and a plating film may be formed on the base electrode film. In this case, a dry treatment or a heating treatment is performed after the base electrode film is formed, and the plating film is thereafter formed. Examples of the plating film include metals of Sn, Au, Ni, Pt, Ag, Pd, etc. or alloy thereof.

In the present embodiment, as shown in FIG. 1, the wire 6 is wound in the core body 4 so that lead ends 6*a* and 6*b* of the wire 6 respectively extend to the end surface 4*e* close to the side surface 4*c* and the end surface 4*f* close to the side surface 4*c*.

In the present embodiment, dummy conductors 7*a* and 7*b* are embedded in the core body 4 separately from the wire 6. The dummy conductors 7*a* and 7*b* are preferably composed of a material identical to that of the wire 6 and are constituted by a rectangular wire composed of a copper wire covered with a resin, for example. In the present embodiment, the dummy conductors 7*a* and 7*b* are positioned close to the lead ends 6*a* and 6*b* so as to respectively overlap with the lead ends 6*a* and 6*b* in a winding axis direction of the wire 6 (Z-axis direction).

For more details, as shown in FIG. 1, the dummy conductor 7*a* is arranged below the lead end 6*a* so that a surface (top surface) 7S1 of the dummy conductor 7*a* on the positive side in the Z-axis direction is closely overlapped in the Z-axis direction with a surface (bottom surface) 6S2 of the lead end 6*a* on the negative side in the Z-axis direction. The dummy conductor 7*b* is arranged above the lead end 6*b* so that a surface (bottom surface) 7S1 of the dummy conductor 7*b* on the positive side in the Z-axis direction is closely overlapped in the Z-axis direction with a surface (top surface) 6S1 of the lead end 6*b* on the positive side in the Z-axis direction.

In the present embodiment, the lead ends 6*a* and 6*b* respectively exposed from the end surfaces 4*e* and 4*f* of the core body 4 are respectively covered and connected with the terminal electrodes 8*a* and 8*b*, and end parts 7S3 and 7S4 of the dummy conductors 7*a* and 7*b* exposed from the end surfaces 4*e* and 4*f* of the core body 4 are respectively covered and connected with the terminal electrodes 8*a* and 8*b*.

The dummy conductors 7*a* and 7*b* have a length in the X-axis direction that is equal to or less than a length in the X-axis direction of the lead ends 6*a* and 6*b* drawn from the coil part 6*a*. The dummy conductors 7*a* and 7*b* preferably have a length in the X-axis direction that is ¼ to ¾ of a length in the X-axis direction of the lead ends 6*a* and 6*b*. The dummy conductors 7*a* and 7*b* preferably have a thickness that is approximately equal to a thickness of the lead ends 6*a* and 6*b*. In addition, the dummy conductors 7*a* and 7*b* preferably have a width in the Z-axis direction that is similar to a width in the Z-axis direction of the wire 6 (lead ends 6*a* and 6*b*).

Figure 2A:
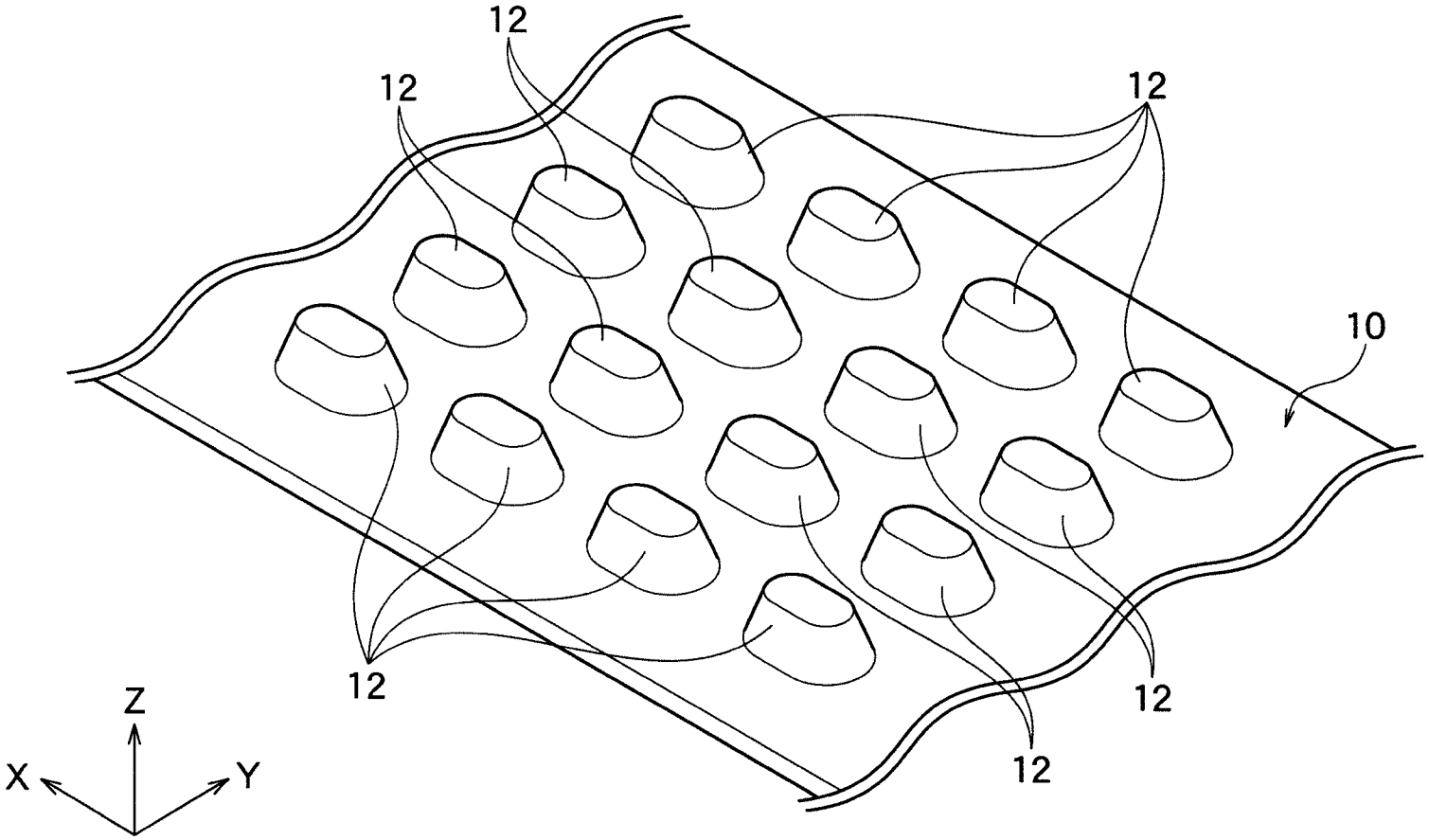
FIG. 2A is a schematic perspective view showing a manufacturing process of the inductor shown in FIG. 1.

Next, a manufacturing method of the coil device 2 according to the present embodiment is described. In the method of the present embodiment, as shown in FIG. 2A, a lower molding material 10 provided with a plurality of positioning protrusions 12 (16 protrusions in the illustrated example) in a matrix form is prepared.

The lower molding material 10 is constituted by a flat sheet composed of a synthetic resin where magnetic particles are dispersed, and is formed by forming the positioning protrusions 12 on the sheet using a die or so.

Figure 2B:
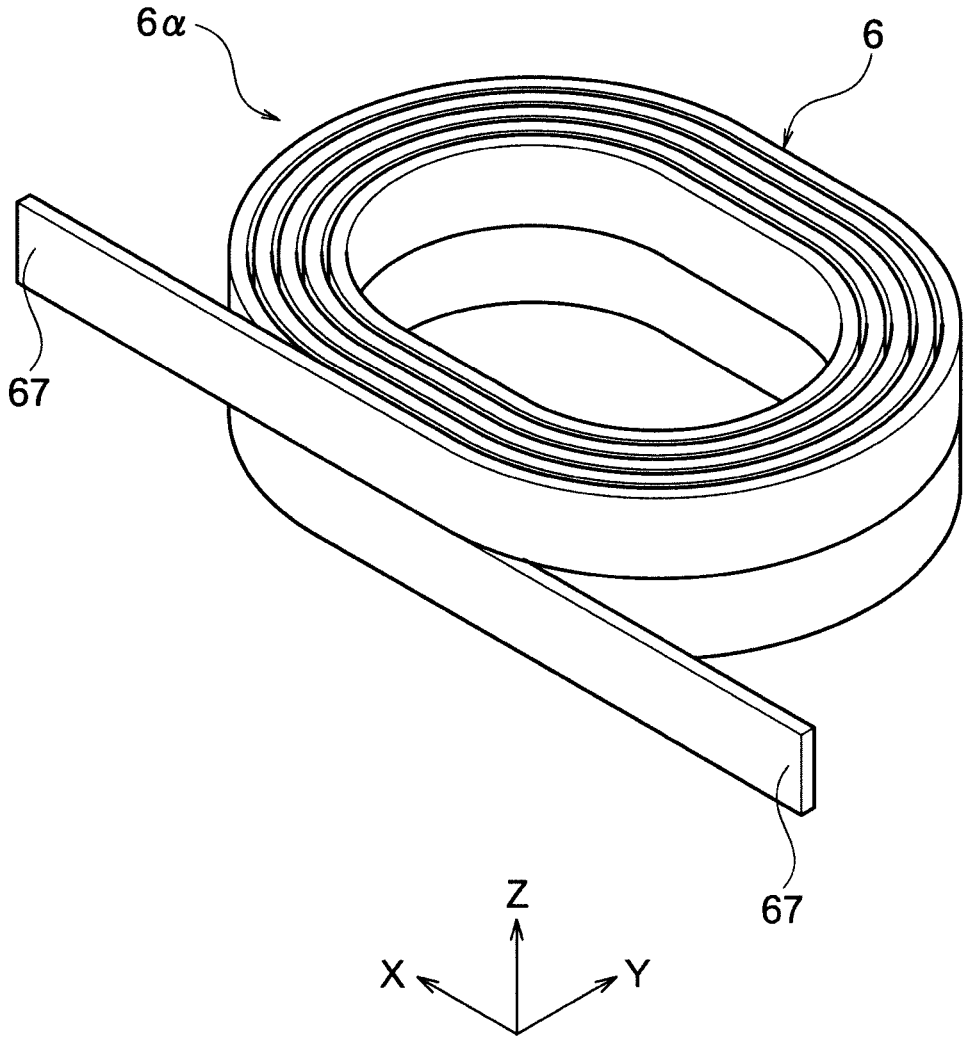
FIG. 2B is a schematic perspective view showing a next step of FIG. 2A.

Next, as shown in FIG. 2B, the wire 6 is wound in a coil shape (winding step), and a plurality of the coil parts 6*a* (16 coil parts 6*a* in the present embodiment) with an air-core coil shape is prepared. A pair of tips 67 of the coil part 6*a* formed by the wire 6 is a part to be the lead ends 6*a* and 6*b* and the dummy conductors 7*a* and 7*b* shown in FIG. 1 in a cutting step below.

Figure 2C:
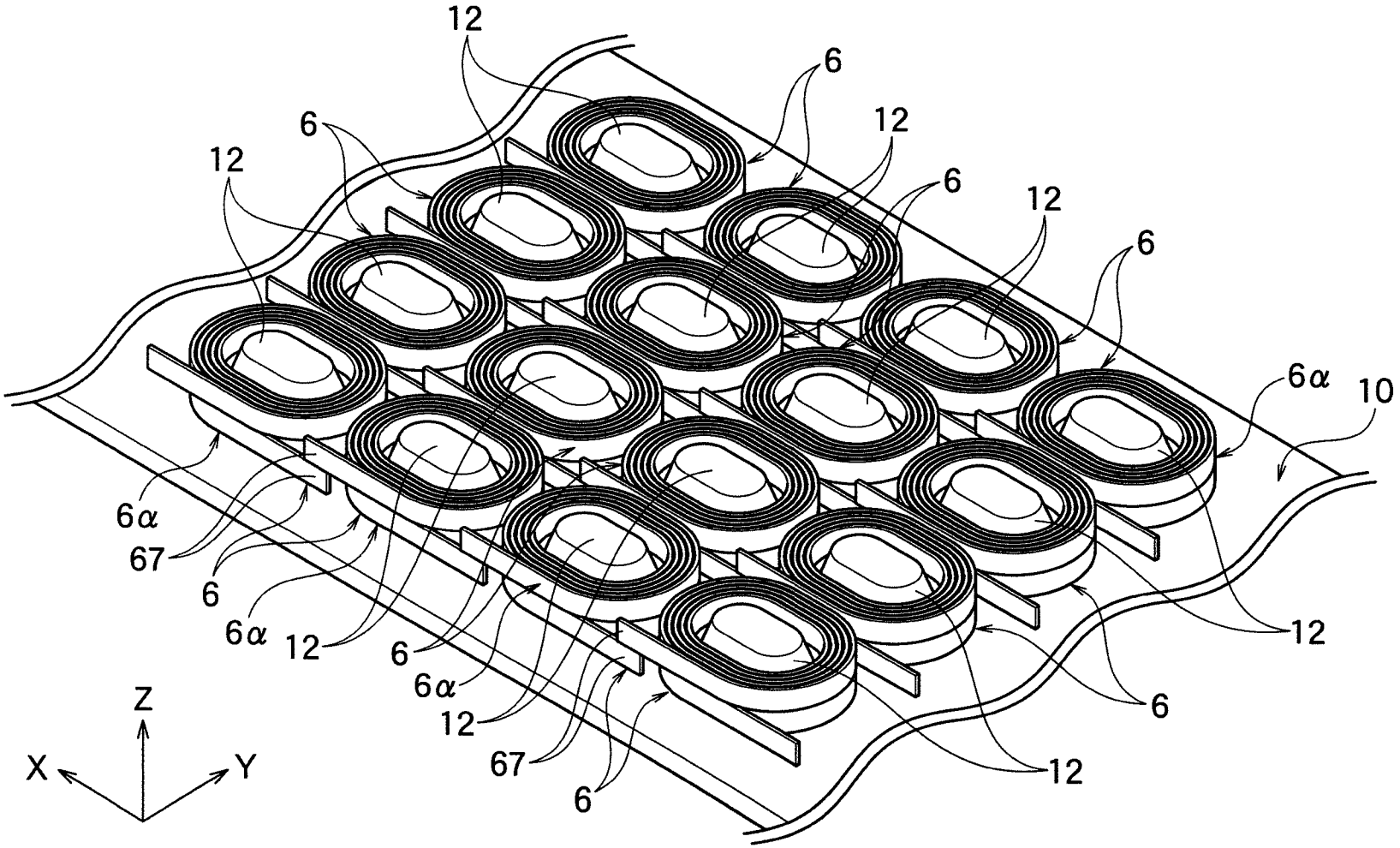
FIG. 2C is a schematic perspective view showing a next step of FIG. 2B.

As shown in FIG. 2C, the coil parts 6*a* constituted by the conductor 6 shown in FIG. 2B are arranged in the positioning protrusions 12 of the lower molding material 10 (coil arrangement step). In the coil arrangement step of the present embodiment, the coil parts 6*a* are arranged so that the positioning protrusions 12 enter into the coil parts 6*a* of a plurality of the wires 6, and that a tip of one wire 6 and a tip of the other wire 6 among the wires 6 adjacent to each other in the X-axis direction are overlapped with each other in the Z-axis direction.

Figure 2D:
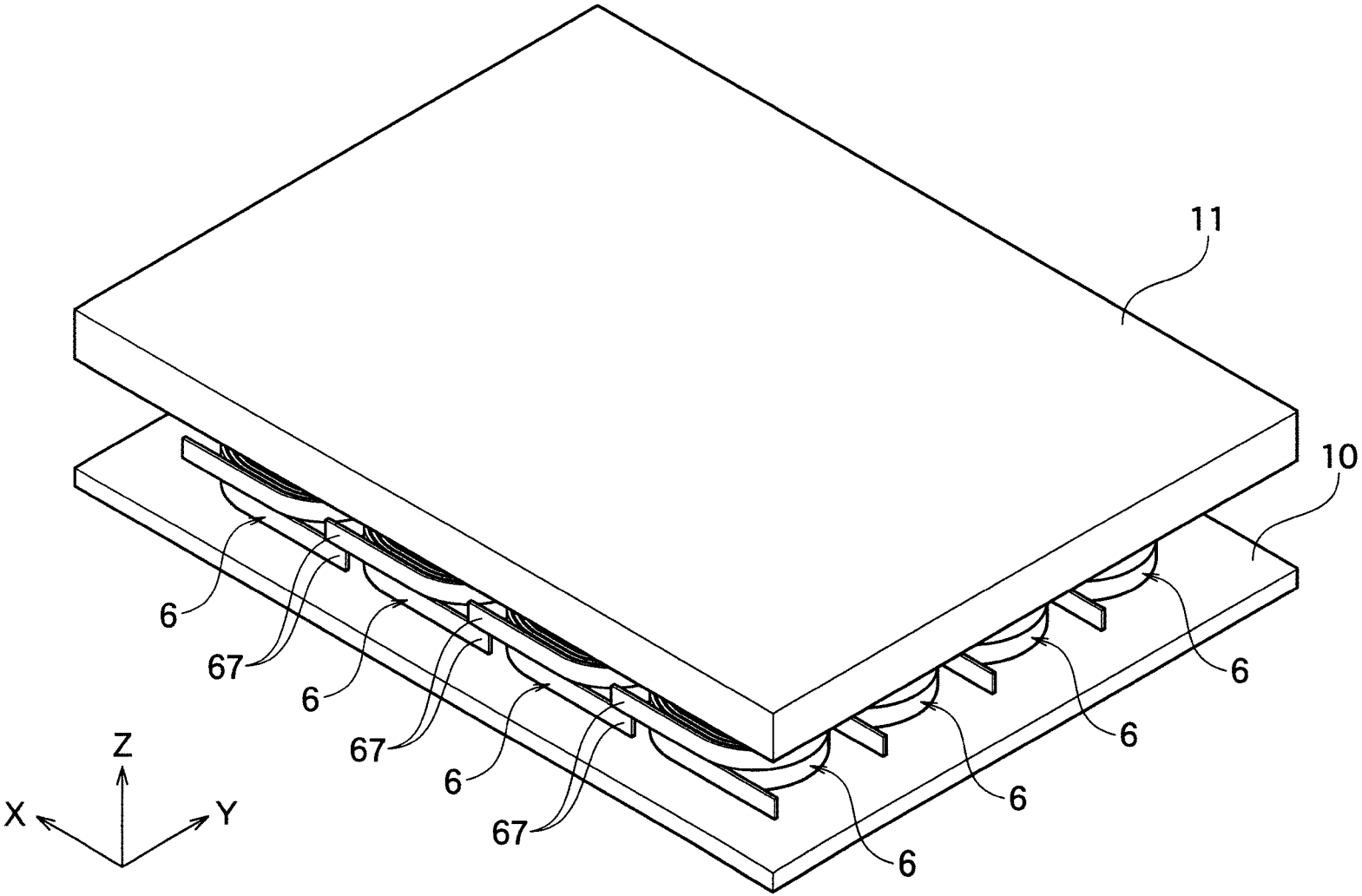
FIG. 2D is a schematic perspective view showing a next step of FIG. 2C.
Figure 2E:
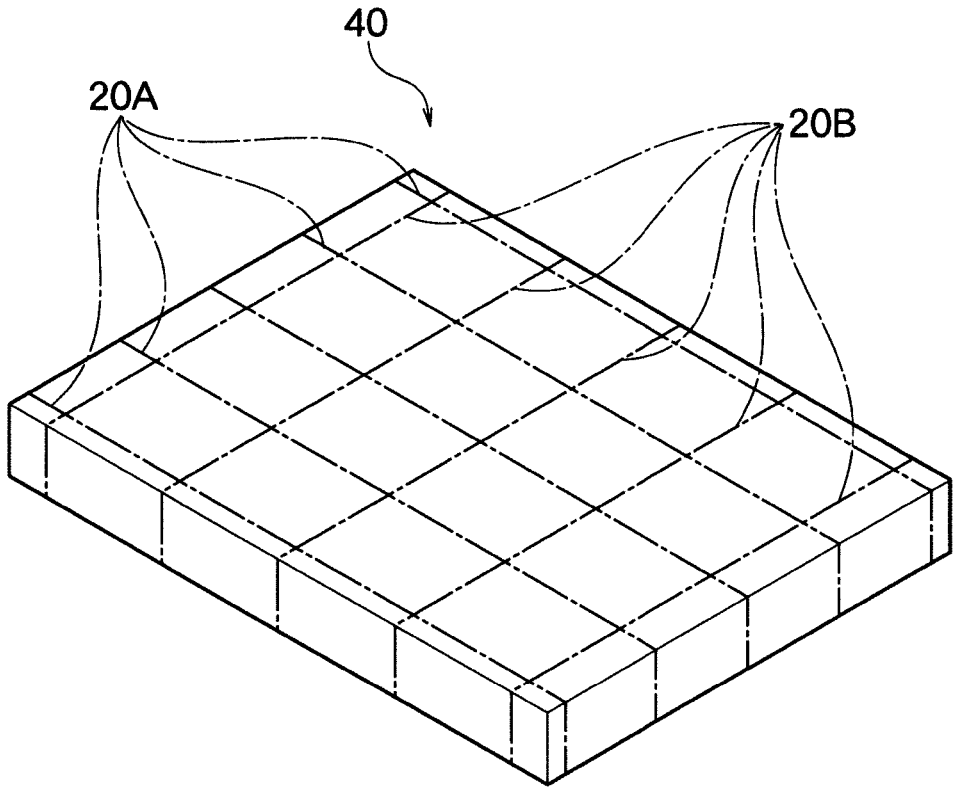
FIG. 2E(a) is a schematic perspective view showing a next step of FIG. 2D.
Figure 2E:
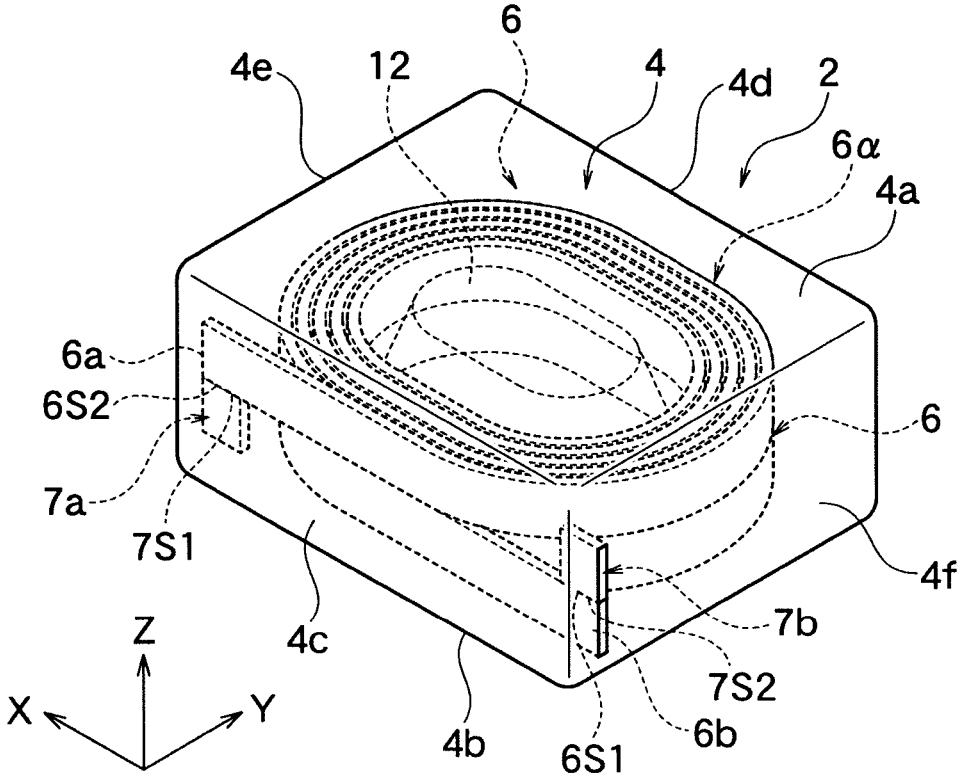

For more details, a plurality of the conductors 6 is arranged in a core body aggregate 40 so that the tip 67 of one wire 6 intrudes into the other region where the other conductor 6 is arranged over a cut projected line 20B shown in FIG. 2E(a), and that the tip 67 of the other wire 6 intrudes into one region where one conductor 6 is arranged over the cut projected line 20B shown in FIG. 2E(a), among the wires 6 (coil parts 6*a*) adjacent to each other in the X-axis direction.

At this time, as shown in FIG. 2C, the tips 67 of the wires 6 are arranged to be positioned on the same side in the Y-axis direction. From this, the tip 67 of one wire 6 overlaps with the tip 67 of the other wire 6, and the tips 67 of the wires 6 are overlapped with each other in the Z-axis direction. Then, overlapped parts are formed.

In the illustrated example, each of the wires 6 is attached to the respective positioning protrusions 12 so that each of the tips 67 is positioned in the front of the Y-axis direction, but each of the wires 6 may be attached to the respective positioning protrusions 12 so that each of the tips 67 is positioned in the back of the positive side of the Y-axis direction.

Next, as shown in FIG. 2D, an upper molding material 11 is prepared, and the lower molding material 10, where the respective wires 6 are arranged, is covered with (lamination) the upper molding material 11. Then, the molding materials 10 and 11 are compressed in the Z-axis direction. The lower molding material 10 and/or the upper molding material 11 thereby flow(s), a space between the molding materials 10 and 11 and the respective wires 6 is filled, and the respective wires 6 and the molding materials 10 and 11 are integrated. As a result, the core body aggregate 40 shown in FIG. 2E(a) is formed.

Incidentally, the upper molding material 11 is similar to the lower molding material 10 except that no protrusions 12 are formed. If necessary, however, the upper molding material 11 may be constituted by a material that is different from a material of the lower molding material 10.

Thereafter, the core body aggregate (preliminary molded body) 40 is cut along the cut projected lines 20A extending in the X-axis direction and the cut projected lines 20B extending in the Y-axis direction (cutting step) as shown in FIG. 2E(a), and the core body 4, where a single wire 6 is embedded, is obtained as shown in FIG. 2E(b). The core body aggregate 40 is cut by any method using a cutting tool, such as a wire saw and a laser.

In the cutting step, when the core body aggregate 40 is cut along the cut projected lines 20B, the tip 67 of the wire 6 contained in the core body 4 in the front of the X-axis direction of the core bodies 4 adjacent to each other in the X-axis direction (see FIG. 2D) is separated and remains as the dummy conductor 7*b* in the core body 4 in the back of the X-axis direction. In the core body 4 in the front of the X-axis direction, the lead end 6*a* is formed at the end of the wire 6 separated from the tip 67.

The tip 67 of the wire 6 contained in the core body 4 in the back of the X-axis direction is separated and remains as the dummy conductor 7*a* in the core body 4 in the front of the X-axis direction. In the core body 4 in the back of the X-axis direction, the lead end 6*b* is formed at the end of the wire 6 separated from the tip 67.

In the present embodiment, a plurality of the wires 6 is arranged in the wire arrangement step so that the tip 67 of one wire 6 and the tip 67 of the other wire 6 are overlapped with each other in the Z-axis direction among the wires 6 adjacent to each other in the X-axis direction. In the core body 4 after being cut, the dummy conductor 7*a* is thereby arranged to overlap with the lead end 6*a* of the wire 6 in the Z-axis direction, and the dummy conductor 7*b* is thereby arranged to overlap with the lead end 6*b* of the wire 6 in the Z-axis direction.

As shown in FIG. 2E(b), the lead end 6*a* of the wire 6 and the end of the dummy conductor 7*a* are exposed as first cut surfaces 6S3 and 7S3 on the end surface 4*e*, which is a cut surface, and the lead end 6*b* of the wire 6 and the dummy conductor 7*b* are exposed as first cut surfaces 6S4 and 7S4 on the end surface 4*f*, which is a cut surface.

Next, the obtained core body 4 undergoes a barrel polishing process (polishing step), for example, and cut metal surfaces of the lead ends 6*a* and 6*b* and cut metal surfaces of the dummy conductors 7*a* and 7*b* are completely exposed on the end surfaces 4*e* and 4*f*, which are a cut surface.

Next, the terminal electrode 8*a* having the extended cover part 8*a*1 and the terminal electrode 8*b* having the extended cover part 8*b*1 are formed on the end surfaces 4*e* and 4*f* by a paste method and/or a plating method (terminal electrode formation step) and undergo a dry treatment or a heat treatment as necessary.

In the terminal electrode formation step, the lead end 6*a* of the wire 6 exposed from the end surface 4*e* of the core body 4 is covered and connected with the terminal electrode 8*a*, and the end of the dummy conductor 7*a* exposed from the end surface 4*e* is covered and connected with the terminal electrode 8*a*. In the terminal electrode formation step, the lead end 6*b* of the wire 6 exposed from the end surface 4*f* of the core body 4 is covered and connected with the terminal electrode 8*b*, and the end of the dummy conductor 7*b* exposed from the end surface 4*f* is covered and connected with the terminal electrode 8*b*.

In the present embodiment, as shown in FIG. 1, the dummy conductors 7*a* and 7*b* are embedded in the core body 4 separately from the conductor 6 wound in a coil shape, and the ends of the dummy conductors 7*a* and 7*b* are respectively connected with the terminal electrodes 8*a* and 8*b*. In addition to the lead ends 6*a* and 6*b* of the conductors 7*a* and 7*b*, the ends of the dummy conductors 7*a* and 7*b* are thereby respectively connected with the terminal electrodes 8*a* and 8*b*, and the terminal electrodes 8*a* and 8*b* become hard to peel from the core body 4. As a result, peeling strengths of the terminal electrodes 8*a* and 8*b* from the core body 4 are improved.

In the present embodiment, the dummy conductors 7*a* and 7*b* are respectively close to the lead ends 6*a* and 6*b* so as to overlap with the lead ends 6*a* and 6*b* along the Z-axis direction, which is a winding axis of the conductor 6. The dummy conductors 7*a* and 7*b* and the lead ends 6*a* and 6*b* are close to each other, but may be connected with or separated from each other. In this configuration, also due to a pressure at the time of molding the core body, an added pressure at the time of cutting the core body, and the like, a part to be the dummy conductor and a part to be the lead end support each other, the lead end is hard to be deformed, and a positional displacement of the lead end is hard to occur.

In the manufacturing method of the inductor 2, as shown in FIG. 2C, the tips 67 of the wires 6 adjacent to each other in the X-axis direction are arranged to mutually intrude into mutual regions over the cut projected lines 20B shown in FIG. 2E(a). Thus, even if the tip 67 of one wire 6 of the wires 6 adjacent to each other in the X-axis direction bends spontaneously toward the coil part 6*a* of the other wire 6, this tip 67 collides with the coil part 6*a* of the other wire 6 and does not bend anymore. Thus, the lead ends 6*a* and 6*b* of the wire 6 formed in the core body 4 after cutting can be prevented from having disproportionally large lengths, and the inductor 2 can be prevented from having a high resistance and uneven resistance values.

Second Embodiment

Figure 3:
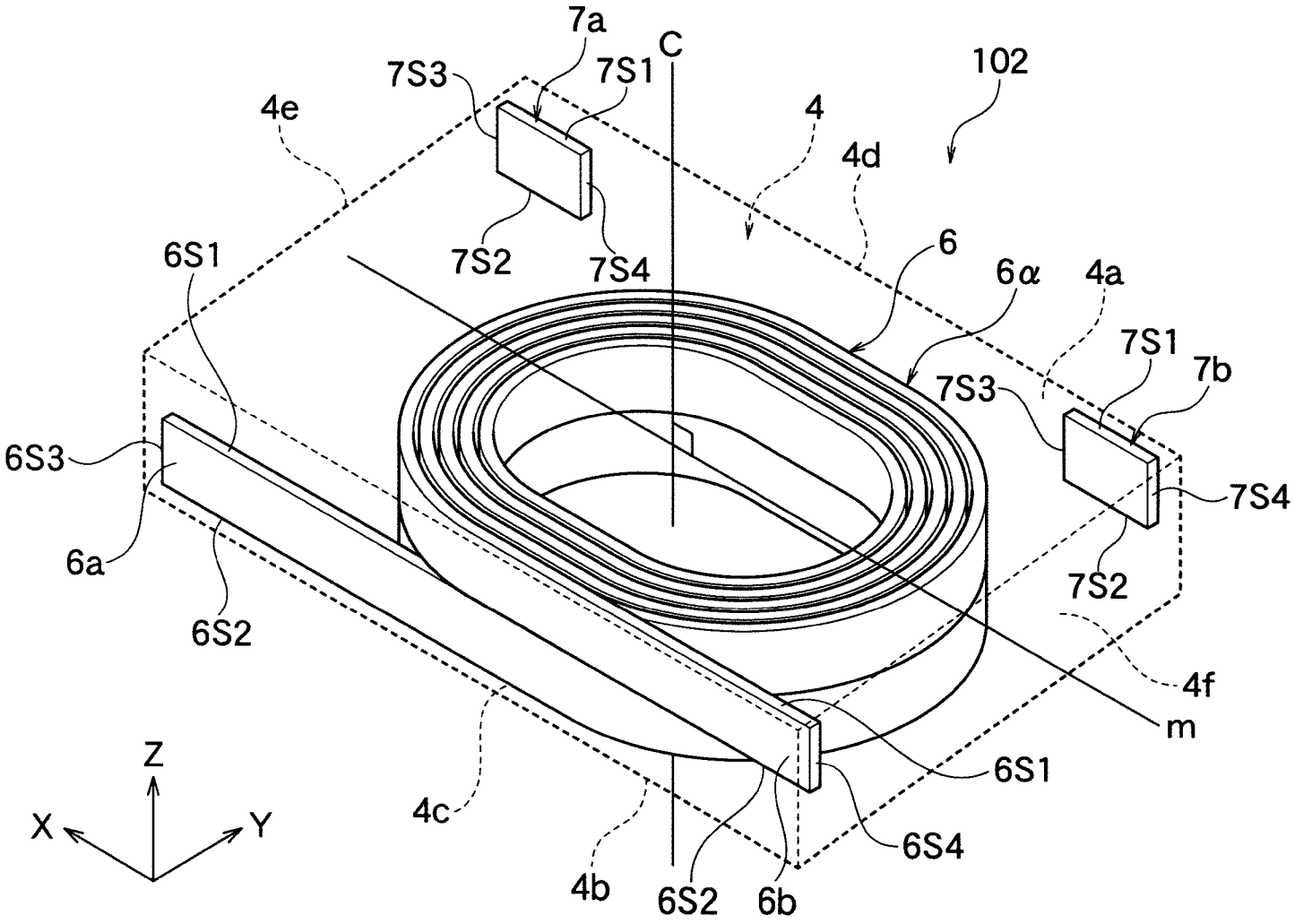
FIG. 3 is a perspective view of an inductor according to Second Embodiment of the present invention.

As shown in FIG. 3, an inductor 102 according to the present embodiment is different from the inductor 2 according to First Embodiment in the following matters and is common with the inductor 2 according to First Embodiment in the other matters. The common matters are not explained.

In the present embodiment, as shown in FIG. 3, when viewed from the X-axis direction, dummy conductors 7*a* and 7*b* are arranged on the opposite side to lead ends 6*a* and 6*b* with the center of a winding axis "c" (parallel to the Z-axis) of a wire 6 on end surfaces 4*e* and 4*f* of a core body 4. When viewed from the positive side of the Z-axis direction, the dummy conductors 7*a* and 7*b* are arranged on the opposite side to the lead ends 6*a* and 6*b* of the wire 6 toward an axis "m" crossing the winding axis "c" of the wire 6 and extending in approximately parallel to the X-axis.

For more details, as shown in FIG. 3, in the present embodiment, the lead end 6*a* is arranged below in the Z-axis direction on the end surface 4*e* positioned close to a side surface 4*c* of the core body 4. On the other hand, the dummy conductor 7*a* is arranged below in the Z-axis direction on the end surface 4*e* close to a side surface 4*d*. The lead end 6*b* is arranged above in the Z-axis direction on the end surface 4*f* close to the side surface 4*c* of the core body 4, and the dummy conductor 7*b* is arranged above in the Z-axis direction on the end surface 4*f* close to the side surface 4*d* of the core body 4.

Figure 4:
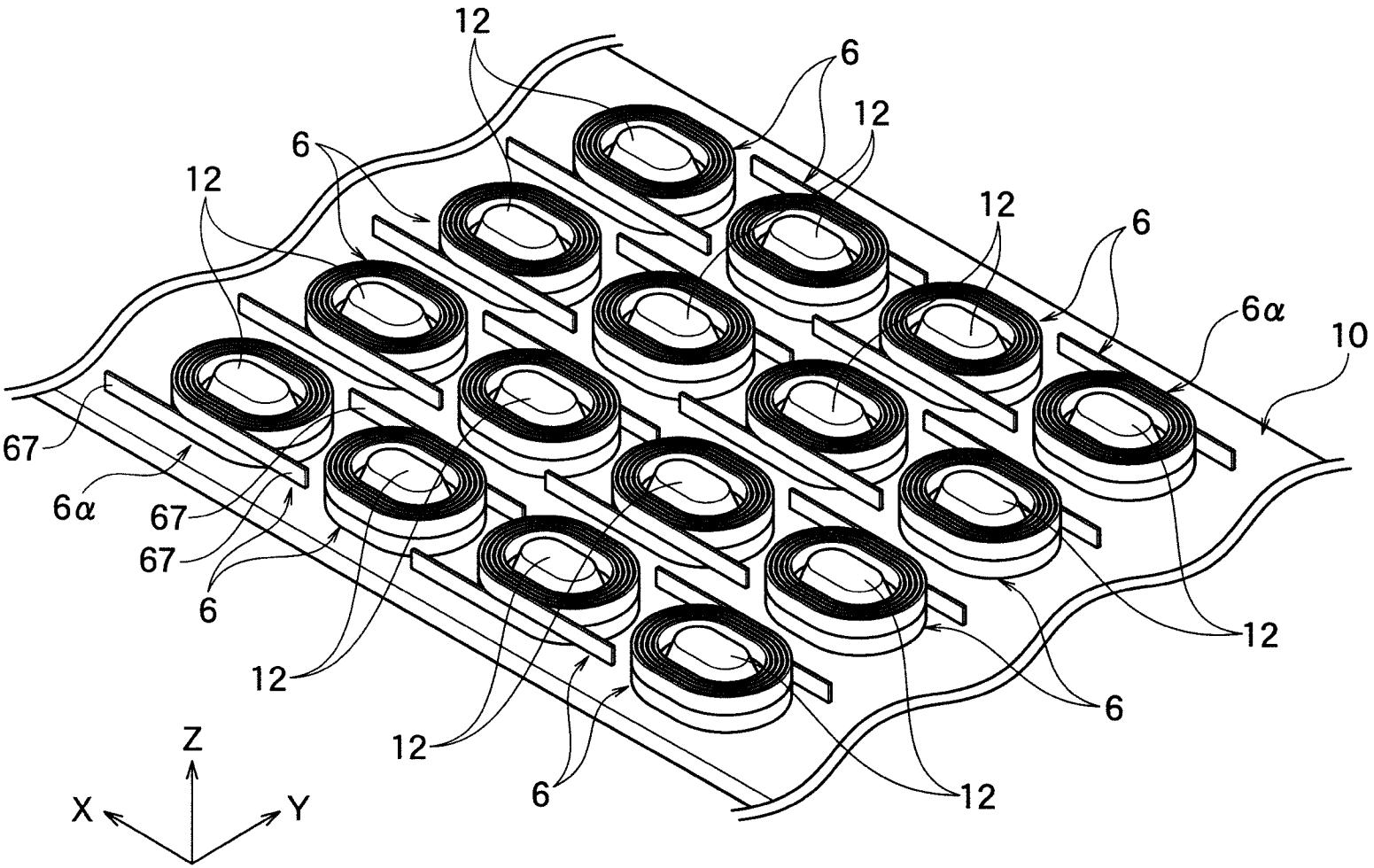
FIG. 4 is a schematic perspective view showing a manufacturing process of the inductor shown in FIG. 3.

In the present embodiment, as shown in FIG. 4, in a wire arrangement step, the respective wires 6 are arranged on a lower molding material 10 so that a tip 67 of one wire 6 and a tip 67 of the other wire 6 are arranged alternately in the Y-axis direction (zigzag arrangement). That is, in the present embodiment, a plurality of the wires 6 is respectively arranged in the X-axis direction while being reversed at 180 degrees in order. The inductor 102 shown in FIG. 3 can be manufactured by arranging the respective wires 6 in such a manner and performing a cut step, a terminal electrode formation step, and the like.

In the present embodiment, the dummy conductors 7*a* and 7*b* are arranged on the opposite side to the lead ends 6*a* and 6*b* with the center of a winding axis of the wire 6 on the end surfaces 4*e* and 4*f* of the core body 4. In this configuration, the dummy conductors 7*a* and 7*b* can be connected with terminal electrodes 8*a* and 8*b* at positions excluding vicinities of the lead ends 6*a* and 6*b*, and connection strengths between the core body 4 and the terminal electrodes 8*a* and 8*b* can be improved with the dummy conductors 7*a* and 7*b* at the positions.

In the present embodiment, as shown in FIG. 3, the lead ends 6*a* and 6*b* of the wire 6 are arranged on one side, and the dummy conductors 7*a* and 7*b* are arranged on the other side, with a winding axis "c" of the wire 6 on the end surfaces 4*e* and 4*f* of the core body 4. Thus, connection strengths between the core body 4 and the terminal electrodes 8*a* and 8*b* are improved with the lead ends 6*a* and 6*b* on one side, and connection strengths between the core body 4 and the terminal electrodes 8*a* and 8*b* are improved with the dummy conductors 7*a* and 7*b* on the other side. Thus, connection strengths between the core body 4 and the terminal electrodes 8*a* and 8*b* are prevented from being unequal, and the terminal electrodes 8*a* and 8*b* become hard to peel from the core body 4.

Incidentally, the present invention is not limited to the above-mentioned embodiments and may be changed variously within the scope of the present invention.

For example, in the example shown in FIG. 1, the dummy conductor 7*a* is arranged in parallel to the X-axis direction, and the whole of the top surface 7S1 of the dummy conductor 7*a* is connected with the bottom surface 6S2 of the lead end 6*a*, but the dummy conductor 7*a* is not limited to being arranged in this manner. The dummy conductor 7*a* may be arranged to be inclined toward the X-axis at a predetermined angle, and only a part of the top surface 7S1 of the dummy conductor 7*a* may be connected with the bottom surface 6S2 of the lead end 6*a*. Likewise, the dummy conductor 7*b* may be arranged to be inclined toward the X-axis at a predetermined angle, and only a part of the bottom surface 7S2 of the dummy conductor 7*b* may be connected with the top surface 6S1 of the lead end 6*b*.

In the example shown in FIG. 1, the dummy conductors 7*a* and 7*b* and the lead ends 6*a* and 6*b* are in contact with each other, but a predetermined space in the Z-axis direction may be arranged between the dummy conductors 7*a* and 7*b* and the lead ends 6*a* and 6*b*.

Moreover, an inductor having both features of the inductor 2 shown in FIG. 1 and the inductor 102 shown in FIG. 3 may be employed. In such an inductor, in a coil arrangement step, tips of one wire 6 and the other wire 6 of some wires 6 of a plurality of wires 6 are arranged to overlap with each other in the Z-axis direction among wires 6 adjacent to each other in the X-axis direction. Then, in the rest of wires 6, tips of one wire 6 and the other wire 6 are arranged alternately in the Y-axis direction among wires 6 adjacent to each other in the X-axis direction.

Both of the dummy conductors 7*a* and 7*b* are exposed from the end surfaces 4*e* and 4*f* in each of the above-mentioned embodiments, but either of the dummy conductors 7*a* and 7*b* may be omitted.

The wire 6 is not limited to a wire covered with insulation, and may be a wire that is not covered with insulation. Moreover, the wire 6 is not limited to a rectangular wire, and may be any kind of wire, such as a round wire, a square wire, and a litz wire. Moreover, a core wire of the wire 6 is not limited to being composed of copper or silver, and may be composed of an alloy containing copper and silver, another metal, or another alloy.

The wire 6 is not limited to having the winding shape in the above-mentioned embodiments, and may have a circular spiral shape, an elliptical spiral shape, an angular spiral shape, or a concentric circular shape.

NUMERICAL REFERENCES

2 . . . inductor (coil device)
4 . . . core body
6 . . . wire
6*a*, 6*b* . . . lead end
7*a*, 7*b* . . . dummy conductor
8*a*, 8*b* . . . terminal electrode
10 . . . lower molding material
11 . . . upper molding material
12 . . . positioning protrusion
20A, 20B . . . cut projected line
40 . . . core body aggregate
67 . . . tip

The invention claimed is:

1. A coil device comprising:

a conductor embedded in a core body and wound in a coil shape; and a terminal electrode formed on an end surface of the core body and connected with a lead end of the conductor;

wherein the coil device further comprises a dummy conductor embedded in the core body separately from the conductor, an end part of the dummy conductor that is exposed from the end surface of the core body separately from the lead end is connected with the terminal electrode, the dummy conductor is comprised of a conductor tip piece cut from another conductor arranged in a core body aggregate from which the core body is obtained, the another conductor being made of the same material as the conductor wound in the coil shape, a thickness and a height of the dummy conductor are respectively substantially equal to a thickness and a height of the lead end, and in a longitudinal direction of the lead end, a length of the dummy conductor is equal to or shorter than a length of the lead end.

2. The coil device according to claim 1, wherein the dummy conductor is arranged close to the lead end so as to overlap with the lead end along a winding axis direction of the conductor on the end surface of the core body.

3. The coil device according to claim 1, wherein the dummy conductor is arranged on an opposite side to the lead end with a center of a winding axis of the conductor on the end surface of the core body.

4. The coil device according to claim 1, wherein the core body is composed of a synthetic resin containing a magnetic material.

5. The coil device according to claim 2, wherein the core body is composed of a synthetic resin containing a magnetic material.

6. The coil device according to claim 3, wherein the core body is composed of a synthetic resin containing a magnetic material.

7. The coil device according to claim 1, wherein the heights of the dummy conductor and the lead end are measured along a direction that is (i) parallel to a winding axis direction of the conductor wound in the coil shape and (ii) perpendicular to the longitudinal direction of the lead end, and the thicknesses of the dummy conductor and the lead end are measured along a direction that is perpendicular to the winding axis direction and perpendicular to the longitudinal direction.

* * * * *